US009163897B1

(12) United States Patent
Estridge et al.

(10) Patent No.: US 9,163,897 B1
(45) Date of Patent: Oct. 20, 2015

(54) BOWSTRING RELEASE DEVICE

(71) Applicant: TruGlo, Inc., Richardson, TX (US)

(72) Inventors: John Estridge, Plano, TX (US); Paul LoRocco, Dallas, TX (US); Damon Lamont Coalson, Dallas, TX (US)

(73) Assignee: TruGlo, Inc., Richardson, TX (US)

( * ) Notice: Subject to any disclaimer, the term of this patent is extended or adjusted under 35 U.S.C. 154(b) by 240 days.

(21) Appl. No.: 13/975,593

(22) Filed: Aug. 26, 2013

(51) Int. Cl.
*F41B 5/18* (2006.01)
*F41B 5/00* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/31, 35.2
See application file for complete search history.

(56) References Cited

U.S. PATENT DOCUMENTS

| | | | | | |
|---|---|---|---|---|---|
| 4,403,594 | A * | 9/1983 | Todd | 124/35.2 |
| 4,625,705 | A * | 12/1986 | Willits | 124/35.2 |
| 5,170,771 | A * | 12/1992 | Peck | 124/35.2 |
| 5,307,788 | A * | 5/1994 | Peck | 124/35.2 |
| 5,318,004 | A * | 6/1994 | Peck | 124/35.2 |
| 5,357,939 | A * | 10/1994 | Tentler et al. | 124/35.2 |
| 5,448,983 | A * | 9/1995 | Scott | 124/35.2 |
| 5,546,924 | A * | 8/1996 | Todd | 124/35.2 |
| 5,558,077 | A * | 9/1996 | Linsmeyer | 124/35.2 |
| 5,596,977 | A | 1/1997 | Scott | |
| 5,653,213 | A * | 8/1997 | Linsmeyer | 124/35.2 |
| 5,765,536 | A | 6/1998 | Scott | |
| 5,871,004 | A * | 2/1999 | Garvison | 124/35.2 |
| 6,058,920 | A * | 5/2000 | Tentler | 124/35.2 |
| 6,763,819 | B2 * | 7/2004 | Eckert | 124/35.2 |
| RE38,833 | E * | 10/2005 | Linsmeyer | 124/35.2 |
| 7,240,672 | B2 * | 7/2007 | Peck et al. | 124/35.2 |
| 7,314,045 | B2 * | 1/2008 | Eckert et al. | 124/35.2 |
| 8,146,578 | B2 * | 4/2012 | Jones | 124/35.2 |
| 8,276,575 | B1 * | 10/2012 | Gillig | 124/35.2 |
| 8,522,764 | B1 * | 9/2013 | LoRocco et al. | 124/35.2 |
| 8,522,765 | B1 * | 9/2013 | LoRocco et al. | 124/35.2 |
| 8,746,223 | B2 * | 6/2014 | Jones | 124/35.2 |
| 2009/0056689 | A1 * | 3/2009 | Jones | 124/35.2 |

* cited by examiner

*Primary Examiner* — Melba Bumgarner
*Assistant Examiner* — Alexander Niconovich
(74) *Attorney, Agent, or Firm* — Alvin R. Wirthlin

(57) ABSTRACT

A bowstring release mechanism includes a housing and first and second jaws pivotally connected to the housing. The first and second jaws have first and second opposing faces. At least one of the jaws is movable with respect to the other jaw. A gap between the opposing faces is also adjustable through a slot formed in a the housing and an adjustment member for adjusting a width of the slot to narrow or widen the slot, and thus the gap.

12 Claims, 5 Drawing Sheets

BOWSTRING RELEASE DEVICE

BACKGROUND OF THE INVENTION

This invention relates generally to archery accessories, and more particularly to a device for releasably holding a bowstring in a drawn position.

In the field of archery, and prior to the advent of the compound bow, bowstrings were drawn by use of the fingers of the archer. In order to protect the fingers, leather protectors that covered the middle and forefingers of the drawing hand and wrapped around the wrist were provided. However, it is well known that manual release of the bowstring adversely affects the flight path and accuracy of the arrow. With the advent of compound bows, more variables were introduced including lateral movement and increased draw forces, thereby making impractical the use of fingers for directly drawing the bow. Accordingly, several bowstring release devices have been proposed over the years.

Although such devices may be adequate for permitting the draw and release of a bowstring to minimize potential injury to the archer and improve shooting accuracy, they are subject to wear, as well as unpredictable and cumulative manufacturing tolerances due to variations in the manufacturing process. The cumulative tolerance errors introduced into the assembly of the various parts of the bowstring release device can lead to assembled products that do not meet the minimum requirements for drawing and holding a bowstring under substantial pull forces. For example, a gap between juxtaposed faces of opposing jaws may become too large to properly hold the bowstring. In such an event, the assembly must be rejected, thus increasing manufacturing costs and labor for bowstring release devices that do pass the minimal manufacturing requirements. In addition, such devices may also become inoperative in the field due to wear caused by repeated use.

Accordingly, it would be desirable to provide a bowstring release mechanism that overcomes at least some of the disadvantages of the prior art.

BRIEF SUMMARY OF THE INVENTION

According to one aspect of the invention, a bowstring release mechanism includes a housing having a first wall segment and a second wall segment separated by a slot. A first jaw is pivotally connected to the first wall segment and a second jaw is pivotally connected to the second wall segment. The first and second jaws have first and second opposing faces, respectively. The first and second jaws are movable with respect to each other between closed and open positions for respectively retaining and releasing a bowstring. An adjustment portion is operatively associated with the first and second wall segments to widen or narrow the slot such that a gap between the opposing faces is adjustable.

According to a further aspect of the invention, a bowstring release mechanism includes a housing having a first wall and a second wall with a space therebetween. The first and second walls have first and second slots, respectively, that divide each wall into first and second wall segments. A first jaw is located in the space and is pivotally connected to the first wall segments of the first and second walls. A second jaw is located in the space and is pivotally connected to the second wall segments of the first and second walls. The first and second jaws have first and second faces that face each other. The first and second jaws are movable with respect to each other between closed and open positions for respectively retaining and releasing a bowstring. An adjustment portion is operatively associated with the first and second wall segments of the first and second walls to widen or narrow the first and second slots such that a gap between the first and second faces is adjustable.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict only typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
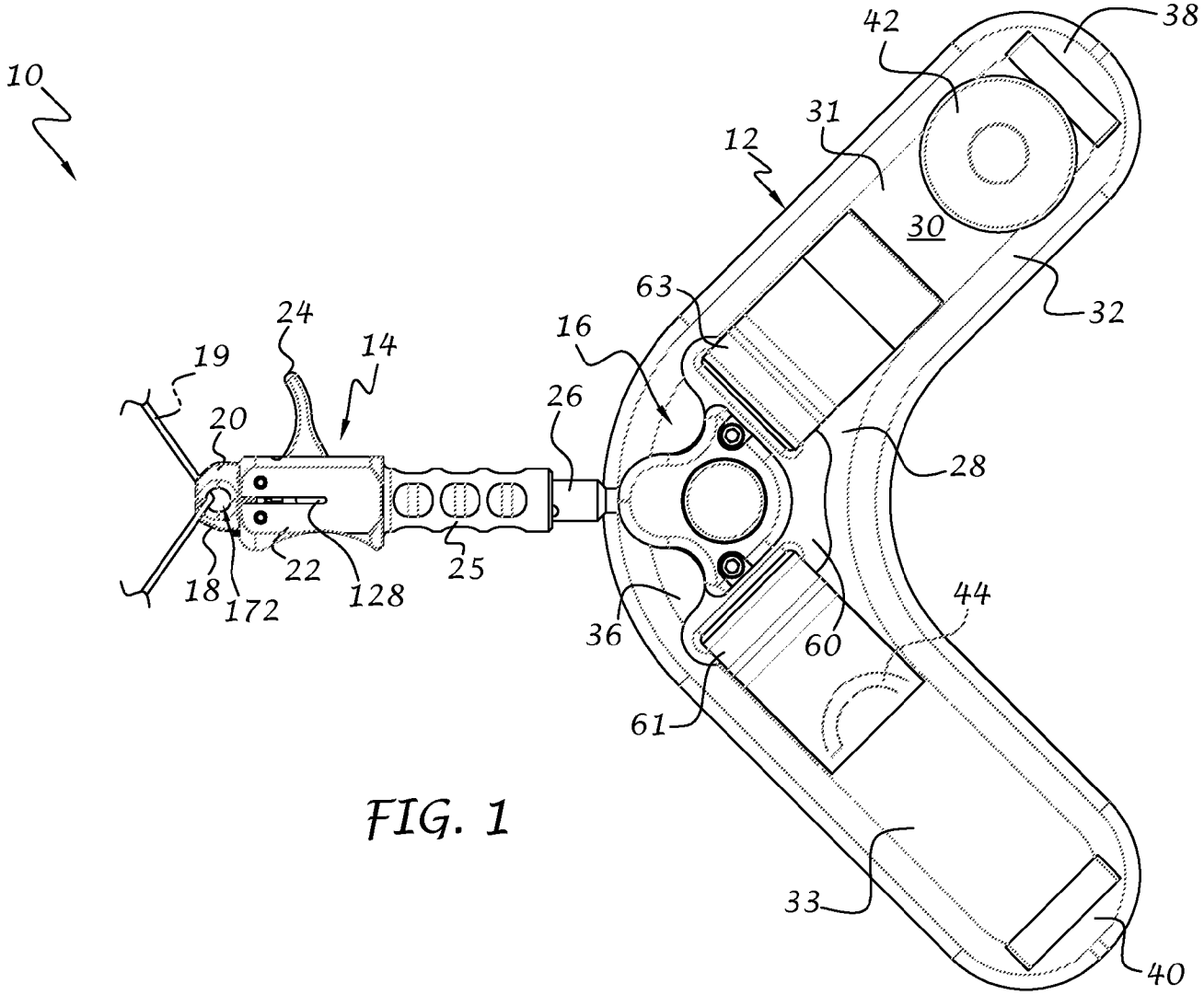
FIG. 1 is a top plan view of a bowstring release assembly in accordance with an exemplary embodiment of the invention.
Figure 2:
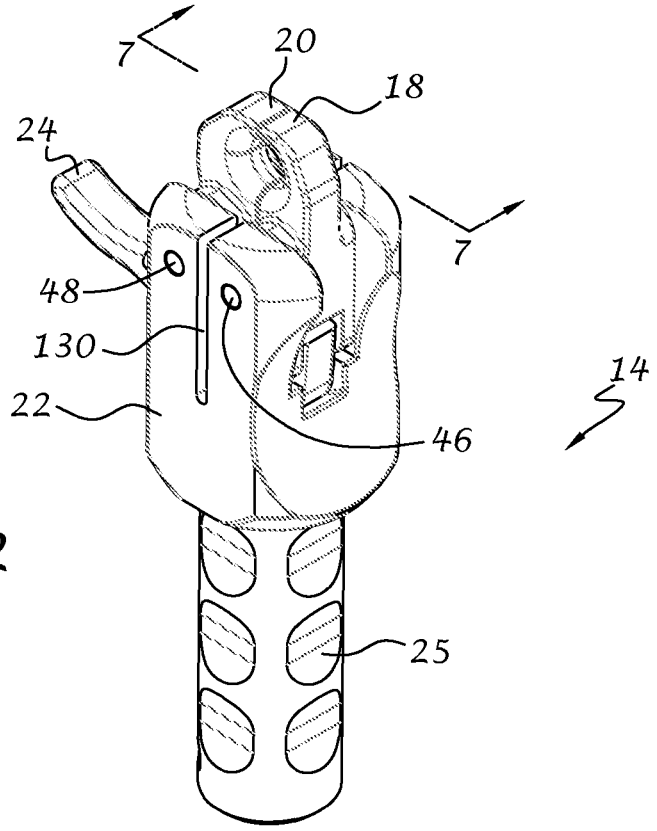
FIG. 2 is an isometric view of a bowstring release mechanism in accordance with the present invention in the closed position for holding a bowstring.
Figure 3:
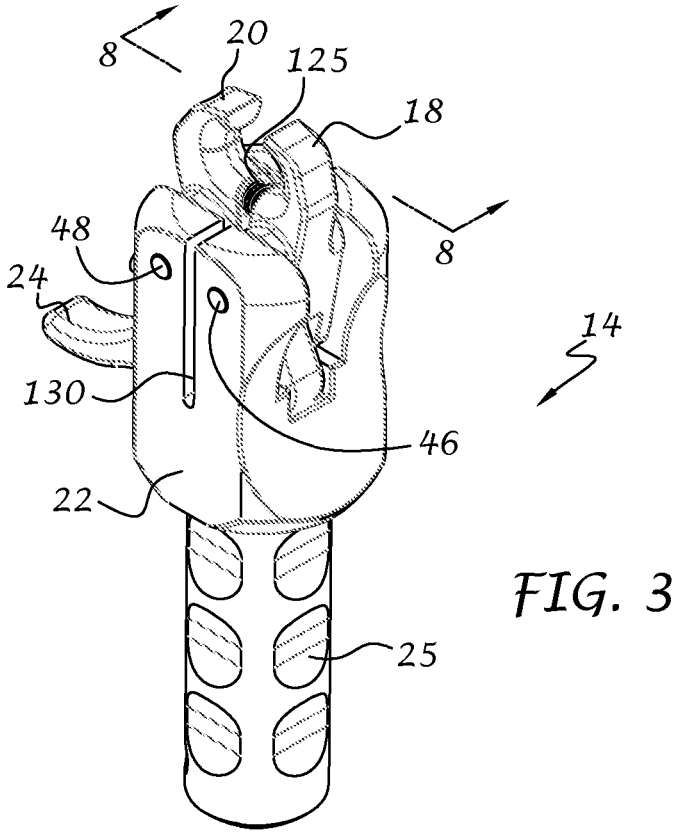
FIG. 3 is an isometric view of the bowstring release mechanism in the open position for receiving and releasing a bowstring.

Referring now to the drawings, and to FIGS. 1-3 in particular, a bowstring release assembly 10 in accordance with the invention is illustrated. The assembly 10 includes a bowstring release mechanism 14 removably connected to a wrist strap 12 via a mounting assembly 16. The bowstring release mechanism 14 extends from the wrist strap 12 for engaging a bowstring and/or a string loop ("D" loop) 19 associated with the bowstring. The present invention is especially suitable for use with compound bows due to the high pull forces that otherwise may injure the fingers of an archer, but may also be used with recurve bows, reflex bows, longbows, and so on.

The release mechanism 14 as shown includes a first jaw 18 and a second jaw 20 that extend outwardly from a housing 22. A trigger 24 also extends from the housing 22 and is operatively associated with one or both jaws such that, when the trigger 24 is pulled, movement of one or both jaws toward an open position occurs, to either release the bowstring or string loop when shooting, or allow entry of the bowstring or string loop into the center of the jaws when getting ready to assume a shooting stance. Likewise, pushing the trigger 24 in the opposite direction, either manually or automatically through a built-in biasing force, causes movement of one or both jaws from the open position toward the closed position to encircle or capture the bowstring or string loop 19. The release mechanism 14 will be described in greater detail below.

An extension member 26 is adjustably connected to the release mechanism 14 and rotationally connected to the mounting assembly 16. The extension member 26 is telescopically received in a connecting portion 25 of the release mechanism 14 for adjusting a fixed distance between the trigger 24 and the mounting assembly 16 to accommodate different hand sizes and preferences of archers so that a proper shooting position can be achieved. It will be understood that other extension members can be used without departing from the spirit and scope of the invention.

An exemplary wrist strap 12 for use with the mounting assembly 16 of the present invention is illustrated in FIG. 1. The wrist strap 12 includes a flexible base member 28 that is adapted to at least partially surround the wrist of an archer. As shown, the base member 28 is generally V-shaped when laid flat and includes a first arm 31 and a second arm 33 converging toward an apex portion 36. The base member 28 has a top surface 30, a first end portion 38 associated with the first arm 31, and a second end portion 40 associated with the second arm 33, that diverge from the apex portion 36. It will be understood that the term "end portion" as used herein can include any portion of the flexible base member up to the apex portion. The flexible base member 28 can be constructed of a center padding layer with an upper lining layer and a lower lining layer (layers not shown) that are connected together via a continuous edging 32 that wraps around the periphery of the wrist strap 12. The edging 32 can be connected to the layers by stitching or other means for connecting the layers together. It will be understood that the base member 28 can be constructed of a single layer of material or, alternatively, more than three layers of material, without departing from the spirit and scope of the invention.

An adjustment mechanism can be connected to the flexible base member 28 for cinching the wrist strap 12 around the wrist of a user with virtually infinite adjustment. The adjustment mechanism preferably includes a first anchor member 42 connected to the top surface 30 of the flexible base member 28 at or near the first end portion 38 of the base member, a second anchor member 44 (shown in hidden line) connected to the top surface 30 at or near the opposite second end portion 40 of the base member 28, and a cable (not shown) that extends between the first and second anchor members. The first anchor member 42 can be in the form of a reel assembly for winding and unwinding the cable while the second anchor member 44 serves to hold a loop of the cable during winding and unwinding. Further details of the wrist strap 12 are described in copending U.S. application Ser. No. 13/314,330 filed on Dec. 8, 2011, and assigned to TruGlo Inc., the disclosure of which is hereby incorporated by reference. It will be understood that the present invention is not limited to the particular wrist strap or mounting assembly shown and described, as the release mechanism of the present invention is adaptable to a wide variety of wrist strap types, styles, sizes, and adjusting mechanisms.

Figure 4:
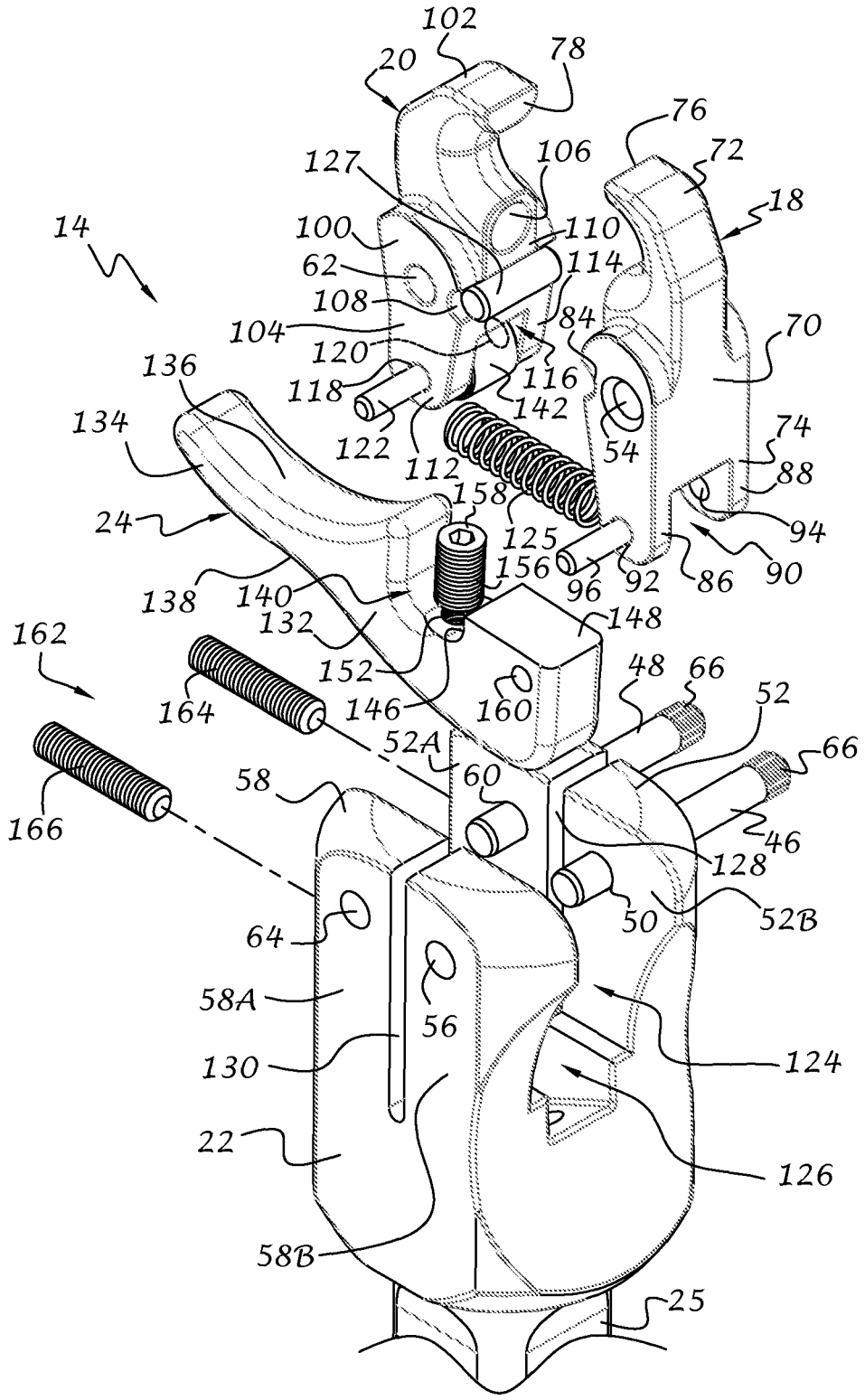
FIG. 4 is an exploded isometric view of the bowstring release mechanism in the closed position.
Figure 7:
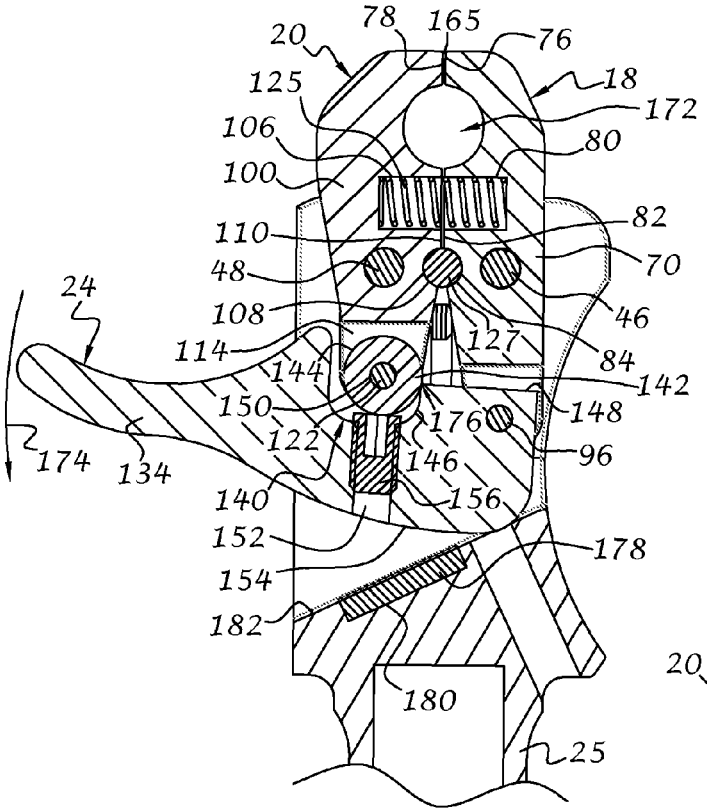
FIG. 7 is a sectional view of the bowstring release mechanism in the closed position taken along line 7-7 of FIG. 2.
Figure 8:
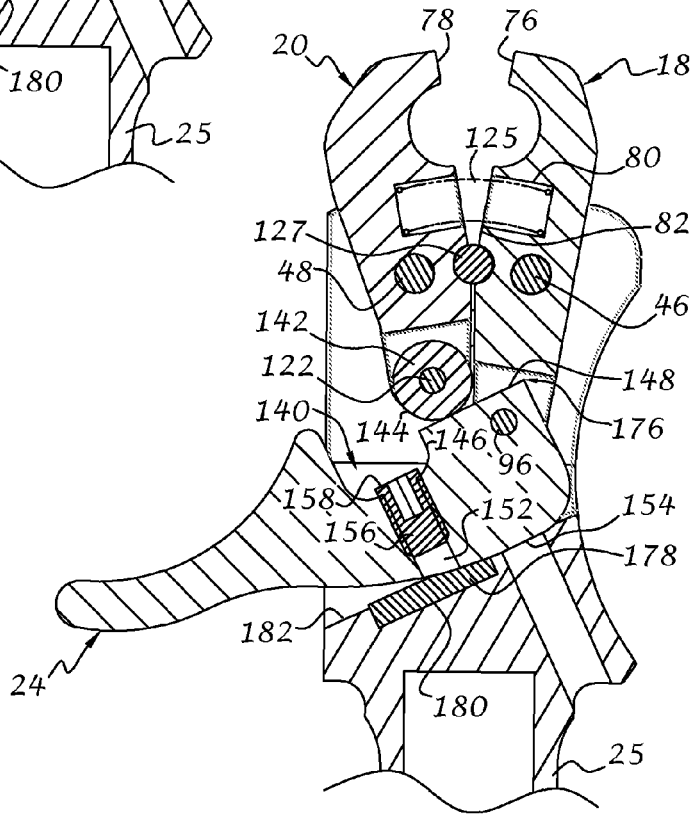
FIG. 8 is a sectional view of the bowstring release mechanism in the open position taken along line 8-8 of FIG. 3.

Referring now to FIGS. 4, 7 and 8, the bowstring release mechanism 14 will now be described in greater detail. The first jaw 18 and second jaw 20 are pivotally connected to the housing 22 via first and second pivot pins 46 and 48, respectively. The first pivot pin 46 extends through an opening 50 (FIG. 4) formed in a first wall segment 52A of a first wall 52 of the housing 22, a pivot opening 54 formed in the first jaw 18, and an opening 56 formed in a first wall segment 58A of a second wall 58 of the housing 22. Likewise, the second pivot pin 48 extends through an opening 60 formed in a second wall segment 52B of the first wall 52 of the housing 22, a pivot opening 62 formed in the second jaw 20, and an opening 64 formed in a second wall segment 58B of the second wall 58 of the housing 22. The pivot pins 46, 48 are preferably cylindrical in shape with grooved or fluted end portions 66 that are press-fit into their respective openings 50, 60 to prevent rotation of the pivot pins with respect to the housing. The openings 54 and 62 of the jaws 18 and 20, respectively, are preferably slightly larger in diameter than the pivot pins so that the jaws 18 and 20 freely pivot about their respective pins.

The first jaw 18 preferably includes a body portion 70, a hook portion 72 extending from the body portion in one direction, and a bifurcated link portion 74 extending from the body portion in an opposite direction. The hook portion 72 preferably curves in a 90-degree arc from the body portion and has a jaw face 76 that faces the jaw face 78 of the second jaw 20 when the release mechanism 14 is in the closed position, as shown in FIG. 7. The body portion 70 preferably includes the pivot opening 54 which extends laterally therethrough, a cylindrically-shaped bore 80 (FIGS. 7 and 8) formed longitudinally in the body portion 70 from a lateral face 82 thereof, and a cylindrically-shaped groove 84 formed in the lateral face 82 and extending laterally therealong. The bifurcated link portion 74 preferably includes a first leg 86 and a second leg 88 that extend from the body portion 70 with a channel 90 located therebetween. Openings 92 and 94 extend through the legs 86 and 88, respectively, for receiving a third pivot pin 96.

The second jaw 20 also preferably includes a body portion 100, a hook portion 102 extending from the body portion in one direction, and a bifurcated link portion 104 extending from the body portion in an opposite direction. The hook portion 102 preferably curves in a 90-degree arc from the housing and has a jaw face 78 that faces the jaw face 76 of the first jaw 18 when the release mechanism 14 is in the closed position. The body portion 100 preferably includes the opening 62 which extends laterally therethrough, and a cylindrically-shaped bore 106 formed longitudinally in a lateral face 110 of the body portion 100. The body portion also includes a cylindrically-shaped groove 108 formed in the lateral face 110 that extends laterally therealong. The bifurcated link portion 104 preferably includes a first leg 112 and a second leg 114 that extend from the body portion 100 with a channel 116 located therebetween. Openings 118 and 120 (shown in hidden line in FIG. 4) extend through the legs 112 and 114, respectively, for receiving a fourth pivot pin 122.

An upper space 124 and a lower space 126 are formed between the walls 52 and 58 of the housing 22. The body portions 70 and 100 of their respective jaws 18 and 20 are located in the upper space 124, while the bifurcated link portions 74 and 104 are located in the lower space 126. A first slot 128 is formed in the first wall 52 of the housing 22. The first slot preferably extends completely through the first wall between the openings 50 and 60 to divide the first wall into first and second wall segments. Likewise, a second slot 130 is formed in the second wall 58 of the housing 22. The second slot preferably extends completely through the second wall between the openings 56 and 64 to divide the second wall into first and second wall segments. The purpose of the slots 128, 130 will be described in greater detail below.

A compression spring 125 is received in the cylindrically-shaped bores 80 and 106 of the first and second jaws 18 and 20, respectively, so that the jaws can quickly separate when the trigger 24 is actuated. A cylindrically-shaped bearing 127 is received in the cylindrically-shaped grooves 84 and 108 of the first and second jaws 18 and 20, respectively, and serves as a mutual pivot connection to allow pivoting movement of the jaws between the open and closed positions, while substantially reducing or eliminating lateral movement of the jaws. Accordingly, the faces 76 and 78 of the jaws 18 and 20, respectively, will remain laterally aligned during pivoting movement between opened and closed positions, as well as when lateral forces may be applied to one or both jaws, such as when the bowstring 19 (FIG. 1) or D-loop may be exerting unequal forces on the jaws during draw-back of the bow, or when improper alignment between the bowstring (or D-loop) and the jaws occurs, for example. The grooves 84 and 108 offer substantially more surface area over prior art arrangements, which helps to reduce the load placed on the jaws since the pivot connection is subjected to linear loading rather than point loading.

The trigger 24 preferably includes a seat portion 132 and a lever portion 134. The lever portion is adapted to be manipulated by a finger or thumb of the user to move the jaws 18, 20 between their open and closed positions and, to that end, preferably includes a first curved segment 136 for engagement with a finger or thumb when pulling the trigger 24 in a direction to open the jaws and a second curved segment 138 on an opposite side of the lever portion 134 for engagement with a finger or thumb when pushing the trigger section in an opposite direction to close the jaws and/or to hold the jaws closed, such as when the bowstring is drawn back to the shooting position. It will be understood that the lever portion 134 can be of any desired shape without departing from the spirit and scope of the invention.

The seat portion 132 is located adjacent to the lever portion 134 and includes a channel 140 for receiving a sear roller 142. The sear roller 142 is preferably cylindrical in shape and has an outer bearing surface 144 that rides along a side wall or first sear surface 146 associated with the channel 140 and a second sear surface 148 as the trigger section 24 is rotated between the jaw closed position shown in FIGS. 2 and 7 and the jaw open position shown in FIGS. 3 and 8. The sear roller 142 also includes a central bore 150 for receiving the fourth pivot pin 122 so that the roller is rotatably mounted thereon between the first leg 112 and second leg 114 of the bifurcated link portion 104. A threaded opening 152 is preferably formed in the bottom wall 154 of the seat portion 132. An adjustment member 156, shown here as a set screw, is located in the threaded opening 152 and includes an upper surface 158 that normally engages the sear roller 142, when the jaw is in the closed position, for adjusting the position of the sear roller with respect to the sear surfaces 146 and 148. In this manner, the sensitivity of the trigger 24 can be adjusted by turning the set screw 156 clockwise or counterclockwise, thereby moving the screw inwardly or outwardly with respect to the channel 140, so that the trigger becomes easier or harder to actuate, thus accommodating the individual preferences of different users. An opening 160 extends transversely through the trigger 24 rearwardly of the seat portion 132 for receiving the third pivot pin 96 so that the trigger 24 is rotatably mounted thereon in the channel 90 between the first leg 86 and second leg 88 of the bifurcated link portion 74.

Figure 5:
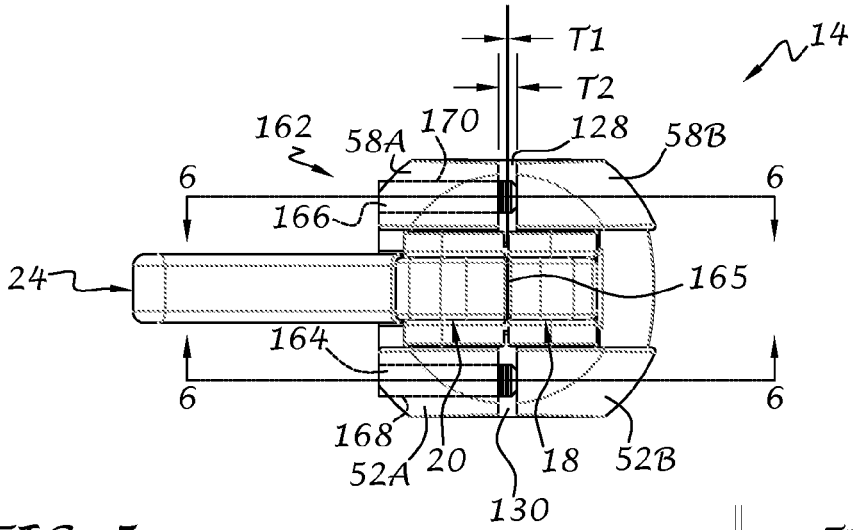
FIG. 5 is front elevational view of the bowstring release mechanism in the closed position.
Figure 6:
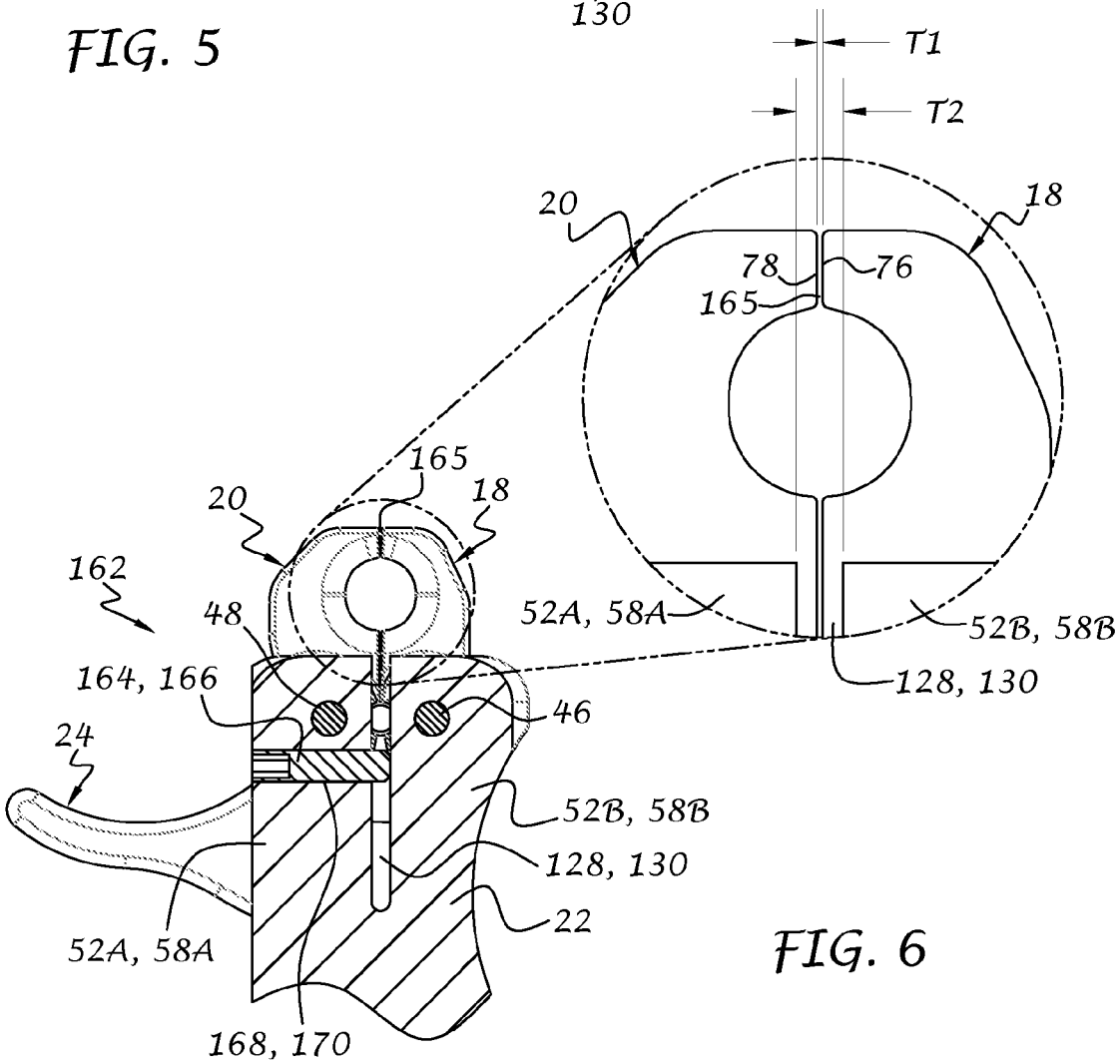
FIG. 6 is a sectional view of the bowstring release mechanism in the closed position taken along lines 6-6 of FIG. 5 and showing an enlarged view of a gap between the jaw faces.

Referring now to FIGS. 4-6, an adjustment portion 162 for varying a gap 165 (FIGS. 5 and 6) by a width or thickness T1 between the jaw faces 76 and 78 is shown. It will be understood that the term "gap" as used herein refers to a space between the jaw faces that can vary between the faces being in direct contact with each other and the faces being separated a distance such that the bowstring passes through when the jaws are in the closed position. The adjustment portion 162 includes the first and second slots 128 and 130 in the first and second walls 52 and 58, respectively, of the housing 22. The slots 128, 130 divide the walls 52, 58 into bifurcated wall segments 52A, 52B, and 58A, 58B. The slots have a width or thickness T2 that can be adjusted via threaded adjustment members 164 and 166, shown here as set screws for example, that engage respective threaded openings 168 and 170 formed in their respective wall segments 52A, 58A, span the slots 128, 130, and press against their associated wall segments 52B, 58B. In this manner, the wall segments 52A, 52B and 58A, 58B are capable of moving toward and away from each other by either narrowing the width T2 of the slots 128, 130 when the set screws 165, 166 are backed out, or by widening the width T2 of the slots when the set screws are tightened. Since the jaw 18 is connected to the wall segments 52A and 58A on one side of the slots 128, 130 and the jaw 20 is connected to the wall segments 52B and 58B on the opposite side of the slots, the width T1 of the gap 165 between the jaw faces will be proportionally adjusted.

In operation, the bowstring 19 (FIG. 1) is located in a space 172 created by the closed jaws of the release mechanism 14. A small gap or slit 165 is preferably formed between the jaw faces 76 and 78 when the jaws are in the closed position. It will be understood that the "gap" or "slit" may be adjusted from completely closed where the jaw faces 76 and 78 are in direct contact with each other, to a position where the jaw faces are separated by a desired distance. Due to tolerance limitations and assembly variations during manufacturing, as well as wear that may occur over time when in use, the gap 165 or a portion thereof may vary from mechanism to mechanism. When manufacturing dimensions vary by larger amounts than desired, a cumulative effect occurs where the jaws may fail to close properly and thus fail to properly hold the bowstring 19, especially when substantial forces are applied against the jaws when the user is in an aiming stance with the bow fully drawn.

Accordingly, the present invention advantageously enables the manufacturer and/or the end user to adjust the gap or slit 165 so that the jaws 18 and 20 are at the proper position to retain the bowstring 19 when substantial forces are present. In order to increase the size T2 of the gap 165, one or both of the adjustment members 164, 166 are rotated in a first direction, such as clockwise, to press the adjustment members against one or more of the wall segments 52B, 58B to thereby cause one or more of the slots 128, 130 to expand in size T2, which ultimately moves the jaws 18 and 20 further away from each other to increase the size T1 of the gap 165 between the jaw faces.

Likewise, in order to decrease the size T2 of the gap 165, one or more of the adjustment members 164, 166 are rotated in a second direction opposite the first direction, such as counter-clockwise, to move one or more of the adjustment members away from one or more of the wall segments 52B, 58B to thereby cause one or more of the slots 128, 130 to contract, which ultimately moves the jaws 18 and 20 closer together to decrease the size T2 of the gap 165 between the jaw faces.

In this manner, deviations in manufacturing dimensions and assembly, and increases in the gap size due to wear, can be precisely controlled without the need for specifying excessively narrow tolerances (which greatly increases manufacturing costs) or disposing of the release mechanism 14 in the event that the size of the gap 165 is not within an acceptable range. Accordingly, a substantial amount of material cost, labor, and unnecessary disposal of mechanisms that would otherwise be out of spec are eliminated by the adjustment capability of the present invention. It will be understood that each slot may be adjusted together or independently. This is especially advantageous if jaw faces are not parallel for various reasons related to manufacturing or use.

In order to separate the jaws 18 and 20 during use, the trigger 24 is pulled or rotated in a direction as noted by arrow 174 in FIG. 7, thereby causing the sear roller 142 to ride along the first sear surface 146, cross the sear edge 176 (FIGS. 7 and 8), otherwise known as the over-center position, between the first and second sear surfaces, and rest on the second sear surface 148, as shown in FIG. 8. As the sear roller crosses the over-center position, the jaws 18 and 20 quickly snap open under biasing force from the compression spring 125 about the bearing 127 to release the bowstring 19. In order to close the jaws 18 and 20, the trigger 24 is rotated in the opposite direction until the sear roller 142 passes the sear edge 176 to thereby cause the jaws to snap closed. With this arrangement, the jaws will not open until released by the trigger 24. A resilient, impact-absorbing pad 178 can be positioned in a depression 180 formed in an inner surface 182 of the housing 22 for cushioning the trigger 24 when the jaws are moved toward the open position. However, it will be understood that the pad 178 and associated depression can be eliminated without departing from the spirit and scope of the invention.

It will be understood that other jaw movement assemblies, with and without sear rollers, can be used without departing from the spirit and scope of the invention, as long as an adjustment portion 162 for varying a gap between the jaw faces 76 and 78 is provided. By way of example, the present invention can be used with a release mechanism having a link arm rather than a sear roller, such as is disclosed in U.S. Pat. Nos. 8,522,764 and 8,522,765 issued on Sep. 3, 2013 to TruGlo, Inc., the disclosures of which are hereby incorporated by reference. It will be further understood that the connecting section can be configured in a variety of different shapes and connecting configurations without departing from the spirit and scope of the invention.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. By way of example, although both jaws of the preferred embodiments of the invention are movable when the trigger is actuated, it will be understood that one of the jaws can remain stationary without departing from the spirit and scope of the invention. In addition, the particular shape of the jaws, the jaw faces, the slots, and so on, are not limited to what has been shown and described, but may encompass other shapes and configurations without departing from the spirit and scope of the invention. By way of example, the slots may be triangular-shaped, square-shaped, and so on, and the jaw faces may be rounded or pointed rather than flat. It will be understood, therefore, that the present invention is not limited to the particular embodiments disclosed, but also covers modifications within the spirit and scope of the invention as defined by the appended claims.

What is claimed is:

1. A bowstring release mechanism comprising:

a housing having a first wall segment and a second wall segment separated by a slot;

a first jaw pivotally connected to the first wall segment, the first jaw having a first face;

a second jaw pivotally connected to the second wall segment, the second jaw having a second face that opposes the first face;

the first and second jaws being movable with respect to each other between closed and open positions for respectively retaining and releasing a bowstring; and an adjustment portion operatively associated with the first and second wall segments to widen or narrow the slot such that a gap between the first and second faces is adjustable.

2. A bowstring release mechanism according to claim 1, wherein the adjustment portion comprises:

a threaded opening extending through the first wall segment; and a threaded adjustment member extending through the threaded opening and the slot for engaging the second wall segment;

wherein rotation of the threaded adjustment member in one direction causes increased pressure against the second wall segment to thereby widen a width of the slot and thus widen the gap between the first and second faces, and rotation of the threaded adjustment member in the opposite direction causes decreased pressure against the second wall segment to thereby narrow the width of the slot and thus narrow the gap between the first and second faces.

3. A bowstring release mechanism according to claim 2, and further comprising a trigger section operably associated with the housing and at least one of the first and second jaws for moving the jaws between the closed and open positions.

4. A bowstring release mechanism according to claim 3, wherein the trigger section comprises a channel with a first sear surface extending along the channel, a second sear surface extending traverse to the first sear surface, and a sear edge located between the first and second sear surfaces, and further comprising a sear roller located in the channel and pivotally connected to the second jaw, the sear roller being movable along the sear surfaces and the sear edge as the jaws move between the closed and open positions.

5. A bowstring release mechanism according to claim 4, and further comprising a second adjustment member operatively associated with the housing and the trigger for adjusting a sensitivity of the trigger.

6. A bowstring release mechanism according to claim 1, and further comprising a trigger section pivotally connected to the first jaw and having a channel with a first sear surface extending along the channel, a second sear surface extending traverse to the first sear surface, and a sear edge located between the first and second sear surfaces, and further comprising a sear roller located in the channel and pivotally connected to the second jaw, the sear roller being movable along the sear surfaces and the sear edge as the jaws move between the closed and open positions.

7. A bowstring release mechanism comprising:

a housing having a first wall and a second wall with a space therebetween, the first and second walls having first and second slots, respectively, that divide each wall into first and second wall segments;

a first jaw located in the space and pivotally connected to the first wall segments of the first and second walls, the first jaw having a first face;

a second jaw located in the space and pivotally connected to the second wall segments of the first and second walls, the second jaw having a second face that faces the first face;

the first and second jaws being movable with respect to each other between closed and open positions for respectively retaining and releasing a bowstring; and an adjustment portion operatively associated with the first and second wall segments of the first and second walls to widen or narrow the first and second slots such that a gap between the first and second faces is adjustable.

8. A bowstring release mechanism according to claim 7, wherein the adjustment portion comprises:

first and second threaded openings extending through the first wall segments of the first and second walls, respectively; and first and second threaded adjustment members extending through the respective first and second openings and first and second slots for engaging the respective second wall segments of the first and second walls;

wherein rotation of the threaded adjustment members in one direction causes increased pressure against the second wall segments to thereby widen a width of the slots and thus widen the gap between the first and second faces, and rotation of the threaded adjustment members in the opposite direction causes decreased pressure against the second wall segments to thereby narrow the width of the slots and thus narrow the gap between the first and second faces.

9. A bowstring release mechanism according to claim 8, and further comprising a trigger section pivotally connected to the first jaw within the space for moving the jaws between the closed and open positions.

10. A bowstring release mechanism according to claim 9, wherein the trigger section comprises a channel with a first sear surface extending along the channel, a second sear surface extending traverse to the first sear surface, and a sear edge located between the first and second sear surfaces, and further comprising a sear roller located in the channel and pivotally connected to the second jaw, the sear roller being movable along the sear surfaces and the sear edge as the jaws move between the closed and open positions.

11. A bowstring release mechanism according to claim 10, and further comprising a second adjustment member operatively associated with the housing and the trigger for adjusting a sensitivity of the trigger.

12. A bowstring release mechanism according to claim 7, and further comprising a trigger section pivotally connected to the first jaw and having a channel with a first sear surface extending along the channel, a second sear surface extending traverse to the first sear surface, and a sear edge located between the first and second sear surfaces, and further comprising a sear roller located in the channel and pivotally connected to the second jaw, the sear roller being movable along the sear surfaces and the sear edge as the jaws move between the closed and open positions.

* * * * *